US007539555B2

(12) United States Patent
Okamoto

(10) Patent No.: US 7,539,555 B2
(45) Date of Patent: May 26, 2009

(54) KNITTING METHOD FOR KNITTING FABRIC, KNITTING FABRIC AND KNITTING PROGRAM

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 278 days.

(21) Appl. No.: 11/596,745

(22) PCT Filed: Apr. 21, 2005

(86) PCT No.: PCT/JP2005/007598

§ 371 (c)(1),
(2), (4) Date: Nov. 16, 2006

(87) PCT Pub. No.: WO2005/116315

PCT Pub. Date: Dec. 8, 2005

(65) Prior Publication Data

US 2008/0028800 A1 Feb. 7, 2008

(30) Foreign Application Priority Data

May 25, 2004 (JP) ..... 2004-154774

(51) Int. Cl.
*D04B 1/24* (2006.01)

(52) U.S. Cl. ..... 700/141; 66/70

(58) Field of Classification Search ..... 66/70, 66/69, 60 R, 73, 175, 176, 76; 700/130, 700/141
See application file for complete search history.

(56) References Cited

U.S. PATENT DOCUMENTS 5,417,088 A 5/1995 Nakai
5,826,445 A * 10/1998 Okamoto ..... 66/70
6,006,551 A 12/1999 Nonnemacher
6,079,232 A 6/2000 Yui
6,672,113 B2 * 1/2004 Okamoto ..... 66/76
6,796,149 B2 9/2004 Okamoto
6,918,270 B2 * 7/2005 Yui ..... 66/176
6,988,384 B2 * 1/2006 Okamoto ..... 66/64
2003/0010067 A1 1/2003 Okamoto et al.
2003/0010069 A1 1/2003 Okamoto et al.

FOREIGN PATENT DOCUMENTS

JP 4-214448 A 8/1992
JP 10-195741 A 7/1998
JP 11-315449 A 11/1999
WO WO 01/55491 A1 8/2001
WO WO 01/61092 A1 8/2001
WO WO 02/066722 A1 8/2002

* cited by examiner

*Primary Examiner*—Danny Worrell
(74) *Attorney, Agent, or Firm*—Rothwell, Figg, Ernst & Manbeck, P.C.

(57) ABSTRACT

A knitting operation and a missing operation are alternately performed at the end portion of a knit fabric around a neck hole to reduce stitch density to less than that on the inside of the knit fabric, the stitch at the end part of the knit fabric is moved every three stitch courses to reduce a knitting width in increments of one stitch, and the stitch is formed at an empty needle resulting from the movement.

Knitting conditions are also excellent since a neck hole or an armhole can be formed at a large slope such as two stitches in the horizontal direction every six stitch courses, and holing in the neck hole or an armhole can also be prevented, while, in addition, the wales are not laterally moved on the inside of the knit fabric.

9 Claims, 9 Drawing Sheets

C1~C9 : Knittig Course

: Widened stitch knitted on an empty needle

: Double stitch

KNITTING METHOD FOR KNITTING FABRIC, KNITTING FABRIC AND KNITTING PROGRAM

CROSS REFERENCE TO RELATED APPLICATION

This application is a 35 USC § 371 National Phase Entry Application from PCT/JP2005/007598, filed Apr. 21, 2005.

TECHNICAL FIELD

The present invention relates to knitting of a knit fabric around a neck hole or an armhole, and more particularly, to such a knitting method and knit fabric, and a knitting program.

BACKGROUND ART

In Japanese Patent No. 2538421, International Patent No. WO 01/055491 and International Patent No. WO 02/092895 are disclosed knitting methods for areas around a neck hole or the like. In Japanese Patent No. 2538421 and International Patent No. WO 01/055491 is disclosed moving the stitches surrounding a neck hole away from the neck hole while forming widening between the moved stitches and the neck hole. The widened stitches are left caught on needles, so that the width of the neck hole increases gradually on account of the widened stitches, while on the widened stitches can also be knitted a collar. In International Patent No. WO 02/092895 is addressed the issue of downward tension in a knit fabric caused by movement during a neck hole formation process. International Patent No. WO 02/092895 studies the problem arising when stitches around a neck hole are moved in the transversal direction (in this specification, the horizontal direction during knitting), as a result of which wales do not become perpendicular, while the downward stress does not act suitably on the stitches caught on the needles, thereby impairing knitting conditions. When in International Patent No. WO 02/092895 is knitted, for instance, a knitted part on the left side of a neck hole, the stitches corresponding to the neck hole or the right side of the neck hole are moved so as not to displace the knitted part on the left side.

As regards the slope of a neck hole or an armhole, the bottom of the neck hole or an armhole is taken as the horizontal (slope zero), while the upper portion of the neck hole or an armhole is made perpendicular. For slopes in between are used knitting methods in which the knitting width is reduced by three stitches every six stitch courses (slope two), or knitting methods with greater numbers of knitting width reduction (slope less than two). No methods are known, however, for knitting a neck hole or an armhole for slopes between a perpendicular slope and a slope of three stitches for every six stitch courses.

DISCLOSURE OF THE INVENTION

The primary object of the invention is to provide a knitting method and a knitting program that allow knitting a neck hole or an armhole with a slope higher than three stitches for every six stitch courses, i.e. with a slope greater than a slope two, and to provide a knit fabric thus knitted.

The above and other objects and features of the present invention will become apparent from the embodiment and effects of the invention described herein below.

The knit fabric of the present invention is a knitting method of a knit fabric, comprising the steps of making stitch density on an end portion of a knitted part lower than on the inside of the knitted part by regularly performing a missing operation with a higher frequency at the end portion than on the inside of the knitted part; performing a formation operation of a widened stitch on an empty needle on the end portion or performing a tuck operation on a needle that holds a stitch, at a rate of once every three to six stitch courses on the inside of the knitted part; reducing the number of stitches formed on a next and subsequent knitting courses by the number of widened stitches formed on the empty needle or by the number of tuck stitches, while leaving the widened stitches or tuck stitches caught on the needle; and knitting subsequently another knitted part on the widened stitches or tuck stitches.

Preferably, on a first knitting course of the end portion is performed a knitting operation for predetermined stitches of the end portion and a missing operation is performed for other stitches of the end portion; and wherein on the end portion is formed a total of one stitch course of the first knitting course and a second knitting course by, on the second knitting course, knitting the end portion transposing the stitches of the knitting operation and the stitches of the missing operation of the first knitting course.

Preferably, a stitch of the end portion is moved to the inside of the knitted part to form an overlap stitch of a destination of an inside stitch and the end portion stitch, the formation operation of the widened stitch being performed next on an empty needle at the end portion resulting from the movement of the stitch. The overlap stitches thus formed become a fashion line between the end portion and the inside thereof.

Preferably, there is further provided a step of forming one stitch course on the end portion by carrying out the first knitting course and second knitting course for the end portion, without forming a stitch course for the inside of the knitted part.

In particular, four stitch courses are preferably knitted at the end portion for every six courses knitted on the inside of the knitted part, while in the meantime is performed a two-stitch formation operation of widened stitches on the empty needle, or a two-stitch tuck operation on a needle that holds the stitches, the number of formed stitches being decreased by two stitches.

The knit fabric having a predetermined slope at the end portion of a knitted part of the present invention has a lower stitch density at the end portion of the knitted part of the knit fabric than on the inside of the knitted part, and has widened stitches or tuck stitches at the end portion at a rate of one stitch per every three to six stitch courses, the number of stitches on a subsequent stitch course being reduced by the number of the widened stitches or tuck stitches, such that another knitted part such as a collar or sleeve rib parts is knitted subsequently on the widened stitches or tuck stitches.

Preferably, the end portion exists around a neck hole or an armhole of the knit fabric, the slope of the neck hole or of the armhole changing through sequential change in the slope of the end portion.

In particular, there are preferably four stitch courses, and two widened stitches or tuck stitches at the end portion, for six stitch courses on the inside of the knitted part.

The knitting program of the present invention is a knitting program of a knit fabric, comprising an instruction for making stitch density on an end portion of a knitted part lower than on the inside of the knitted part by regularly performing a missing operation with a higher frequency at the end portion than on the inside of the knitted part; an instruction for performing a formation operation of a widened stitch on an empty needle on the end portion or performing a tuck operation on a needle holding a stitch, at a rate of once every three to six stitch courses on the inside of the knitted part; an instruction for reducing the number of stitches formed on a next and subsequent knitting courses by the number of widened stitches formed on the empty needle or by the number of tuck stitches, while leaving the widened stitches or tuck stitches caught on the needle; and an instruction for knitting subsequently another knitted part on the widened stitches or tuck stitches.

In the present description, stitch course refers to a line of interlinked stitches formed in the horizontal direction of a knitting machine such as a horizontal knitting machine or the like. Stitch density takes precedence in the numeration of the stitch courses at the end portion of the knitted part; when on the inside of the part is formed one-course worth of stitches then at the end portion is also formed one-course worth of stitches. Also, a knitting course refers to the unit operation whereby, for instance, a stitch course or the like is formed; in the case of a knitting machine provided with a carriage, for example, one knitting course is the carriage stroke corresponding to the width of the knitted part. Herein, two knitting courses correspond to one stitch course when at the end portion stitches are formed by knitting every other stitch on one knitting course, and then, on the next knitting course, new stitches are formed on the remaining stitches at the end portion.

The knit fabric knitted in the invention may be a tubular knit fabric such as a sweater, a vest, a dress or the like, or a non-tubular knit fabric such as a cardigan, a gown or the like. The tubular knit fabric may be knitted from the start through seamless tubular knitting, or may be made tubular through sewing after non-tubular knitting.

In the knitted part of the invention, the area around a neck hole or an armhole may be used for subsequently knitting a collar or a neck on the neck hole, or for joining a sleeve as the armhole is formed.

ADVANTAGES IN THE INVENTION

Through the use of a missing operation, stitch density becomes lower at the end portion of a knitted part than in the inside of the part in the knitting method or knitting program of the present invention. Although they appear at different positions in the course direction defined in FIG. 1, the bottom and periphery of the neck hole or armhole are locked at the same height in a knitting machine. A lower stitch density at the end portion of a knitted part around the neck hole, armhole or the like improves drooping of the knit fabric, and improves also knitting conditions.

At the end portion of the knitted part, the knitting width narrows at a rate of one stitch every three to six stitch courses, which results in a slope of three to six at the end portion, i.e., a slope can be obtained between a conventional slope two and a vertical slope. Also, a collar, sleeve rubber or the like can be knitted subsequently on unremoved widened stitches or tuck stitches knitted on empty needles and left on the needles.

A beautiful collar or sleeve having for instance an arcuate or semicircular shape is obtained thus when the neck hole or armhole is joined to a horizontal bottom portion, a conventional slope two portion, a slope three portion or the like of the present invention or a vertical portion, by changing the slope of the neck hole or armhole substantially in a continuous fashion.

To lower the stitch density at the end portion stitches are formed, for instance, over about half the end portion on the initial knitting course, the remaining half of the stitches being formed on the next knitting course, so that one stitch course can be formed on two knitting courses. If the number of stitches at the end portion is for instance one to four stitches, stitch density can be changed even when for instance all the stitches of the end portion are missed or knitted on predetermined knitting courses, for instance by missing or knitting two courses every six knitting courses.

When widened stitches are formed on an empty needle, overlap stitches are formed by moving stitches of the end portion to the inside to the knitted part on every predetermined stitch course, the overlap stitches yielding then a fashion line. The width of the neck hole or armhole expands thus at a predetermined slope since the number of subsequently formed stitches is reduced by the number of widened stitches or tuck stitches. Moreover, no holes form between parts such as a collar, sleeves or the like upon formation of widened stitches or tuck stitches, in particular upon formation of widened stitches or tuck stitches on the farthest end portion. The number of widened stitches may also be increased, as described for instance in Japanese Patent No. 2538421.

Providing four stitch courses at the end portion for every six stitch courses on the inside of the knitted part affords a suitable number of stitches at the end portion when the slope of the end portion of the knitted part is three. One stitch course at the end portion for every two knitting courses implies three stitch courses at the end portion for every six stitch courses on the inside of the knitted part, which is insufficient by one stitch course. Herein it is possible to provide four stitch courses at the end portion for every six stitch courses on the inside of the knitted part, without forming stitch courses on the inside of the knitted part, by adding a step of forming one stitch course at the end portion on two knitting courses.

In the knit fabric of the present invention, thus, a collar or sleeves can be provided with easily knitted slope portions having a slope between a vertical slope and a slope two, without holes forming around the collar or sleeves. Collars or sleeves of arbitrary shape can thus be realized by combining the above portions with other portions having different slopes.

The knitting program of the invention allows implementing the above knitting method in a knitting machine such as a horizontal knitting machine or the like.

DESCRIPTION OF THE SYMBOLS

| | |
|---|---|
| 2, 22 | vest |
| 6, 26 | armhole |
| 9 | side rubber |
| 14, 24, 25 | fashion line |
| 42 | turtleneck sweater |
| 46 | neck |
| 52, 54 | fashion line |
| 64 | knitted part |
| 100, 102 | end portion line |
| 132 | control unit |
| 136 | display unit |
| 140 | stylus |
| 144 | storage medium |
| 4, 24 | neck hole |
| 8 | collar |
| 10, 12 | knitted part |
| 30~36 | knitted part |
| 44 | body |
| 48, 50 | knitted parts |
| 62 | gown |
| 66 | fashion line |
| 130 | horizontal knitting machine |
| 134 | knit design device |
| 138 | keyboard |
| 142 | end portion knitting program |

BEST MODE FOR CARRYING OUT THE INVENTION

Preferred embodiments for carrying out the invention are explained next.

Figure 1:
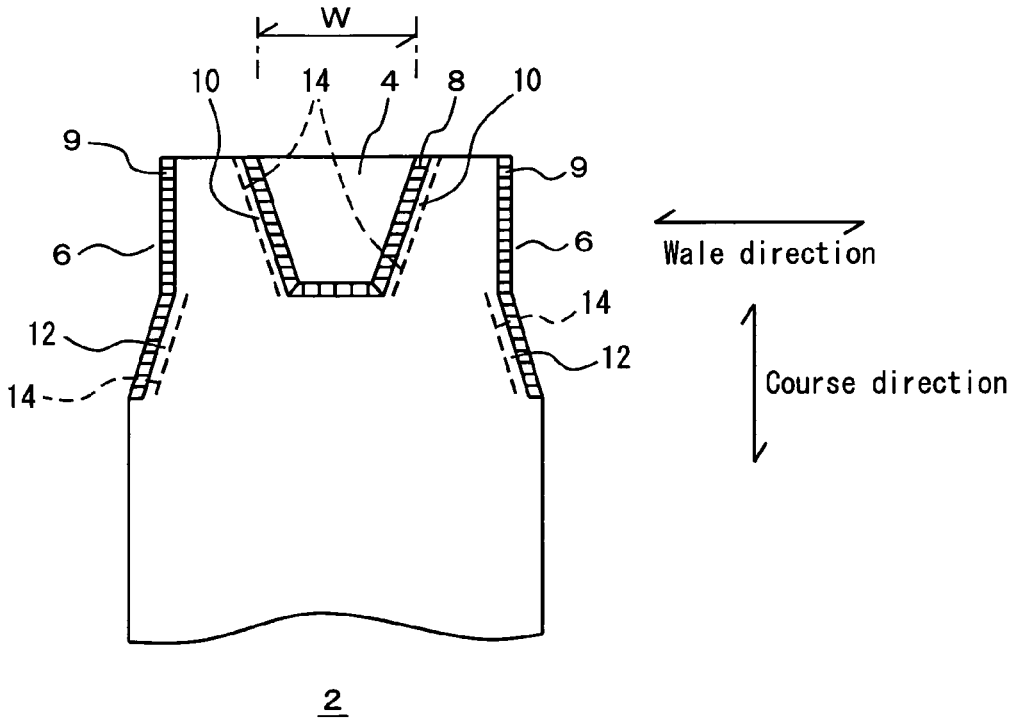
FIG. 1 is a front-view diagram of a relevant portion of a vest knitted in an embodiment of the invention.

An embodiment and a modification thereof are illustrated in FIGS. 1 to 13. FIGS. 1 through 4 illustrate a knit garment knitted in an embodiment. In FIG. 1, the reference numeral 2 denotes a vest, 4 a neck hole, 6 an armhole, 8 a collar knitted on the neck hole 4, and 9 a side rubber knitted along the armhole 6. The knitted part 10 on the inside of the neck 8 or the knitted part 12 on the inside of the side rubber 9 in the present embodiment are knitted parts formed by knitting, the end portions thereof on the neck hole 4 or armhole 6 being end portions of the knitted parts 10, 12. The reference numeral 14 denotes a fashion line, which is a line of overlap stitches formed together with the knitted parts 10, 12.

The vest 2 is knitted as a seamless tubular shape in a two-bed or four-bed knitting machine. An upper opening of the neck 8, called a "sky neck", has a width W. In the body of the knit garment such as the vest 2 or the like in the embodiment, a wale direction is the horizontal direction and the course direction is the vertical direction (perpendicular direction).

Figure 2:
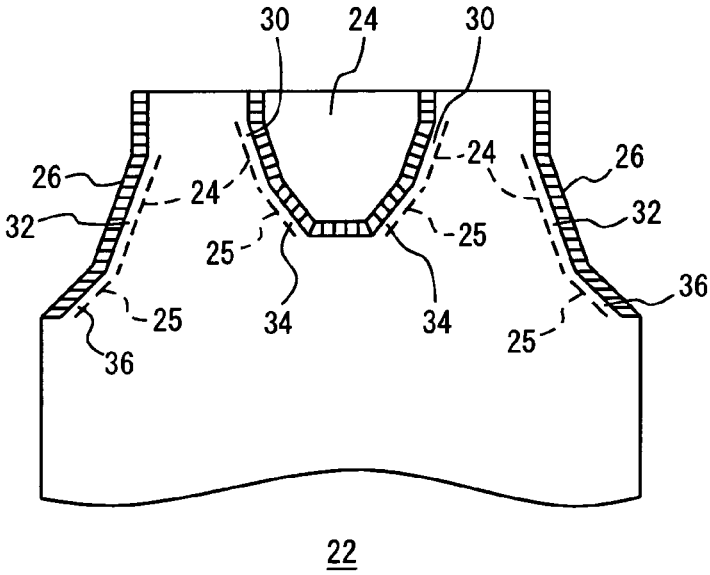
FIG. 2 is a front-view diagram of a relevant portion of a vest in a modified embodiment of the invention.

In a vest 22 in FIG. 2, the slope of a neck hole 24 or an armhole 26 changes gradually, so as to resemble a neck or sleeve having an arcuate, semicircular shape or the like. The neck hole 24, for instance, has a horizontal bottom, a knitted part 34 of the collar has a slope two and a knitted part 30 has a slope three, with the slope becoming perpendicular beyond the knitted part 30 towards the top of the neck. In the armhole 26, similarly, a knitted part 36 has a slope two and a knitted part 32 has a slope three, with the slope becoming perpendicular beyond the knitted part 32 towards the upper portion of the armhole 26. Fashion lines 24 are fashion lines generated at the portions of slope three, while fashion lines 25 are fashion lines generated at the portions of slope two.

Figure 3:
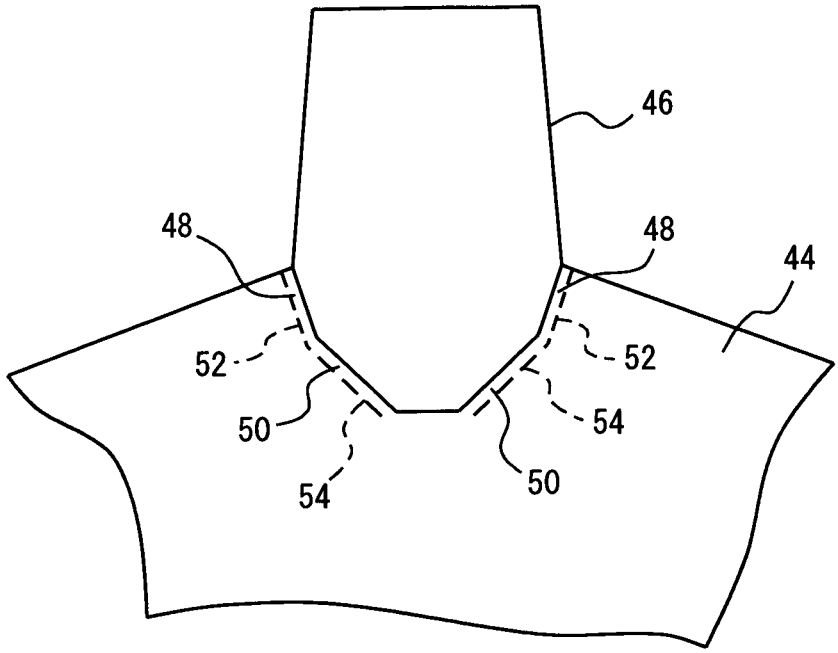
FIG. 3 is a front-view diagram of a relevant portion of a turtleneck sweater knitted in the embodiment.
Figure 4:
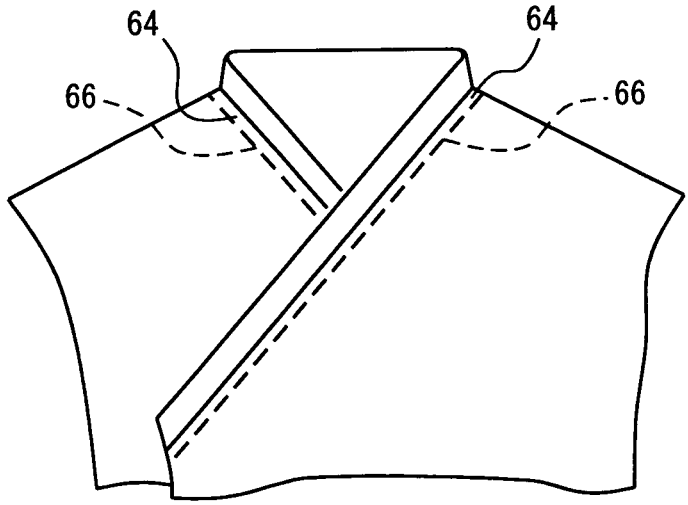
FIG. 4 is a front-view diagram of a relevant portion of a gown knitted in the embodiment.

In FIG. 3, the reference numeral 42 denotes a turtleneck sweater, 44 a body, and 46 a neck. The embodiment is applied to the portion of the neck hole at the lower side of the neck 46, the portion being knitted in accordance with the embodiment, wherein the reference numerals 48 and 50 denote knitted parts along the neck hole, and 52 and 54 denote fashion lines, with slopes three in the knitted part 48 or the fashion line 52. In the knitted part 50 and the fashion line 54 there are slopes two, which are knitted for instance in accordance with the comparative embodiment of FIG. 9. The end portions of the knitted parts knitted in the embodiment form thus a boundary with other knitted parts such as a collar, a side rubber or the like. In the vest 22 of FIG. 2, moreover, the knitted parts 32, 36 appear at the boundary portion between the sleeves and the body if the sleeves are provided extending from the armholes 26. In the gown 62 illustrated in FIG. 4, the embodiment is applied to the knitting of the portion of a knitted part 64, the reference numeral 66 denoting herein a fashion line formed along the knitted part 64.

Figure 5:
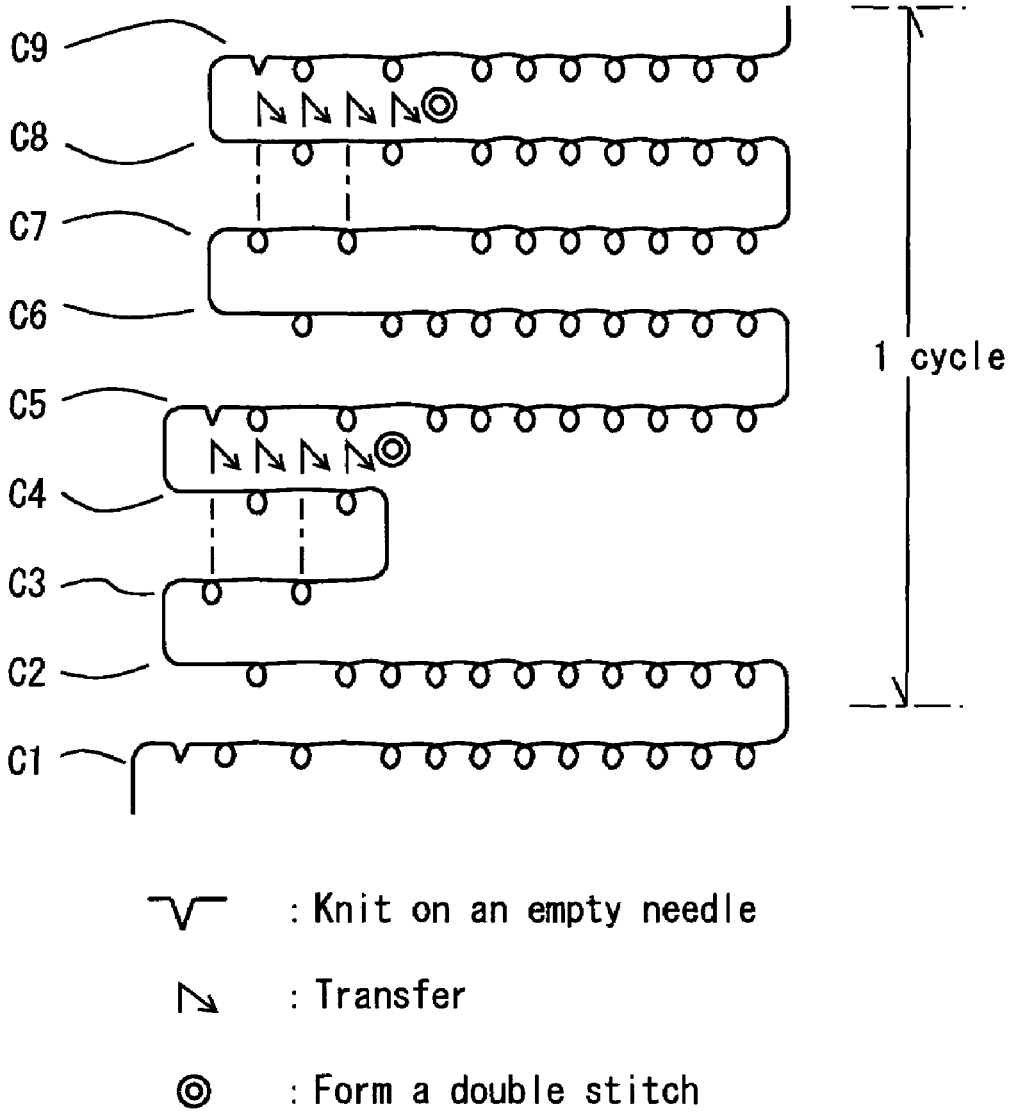
FIG. 5 is a diagram illustrating a knitting procedure of the embodiment.
Figure 6:
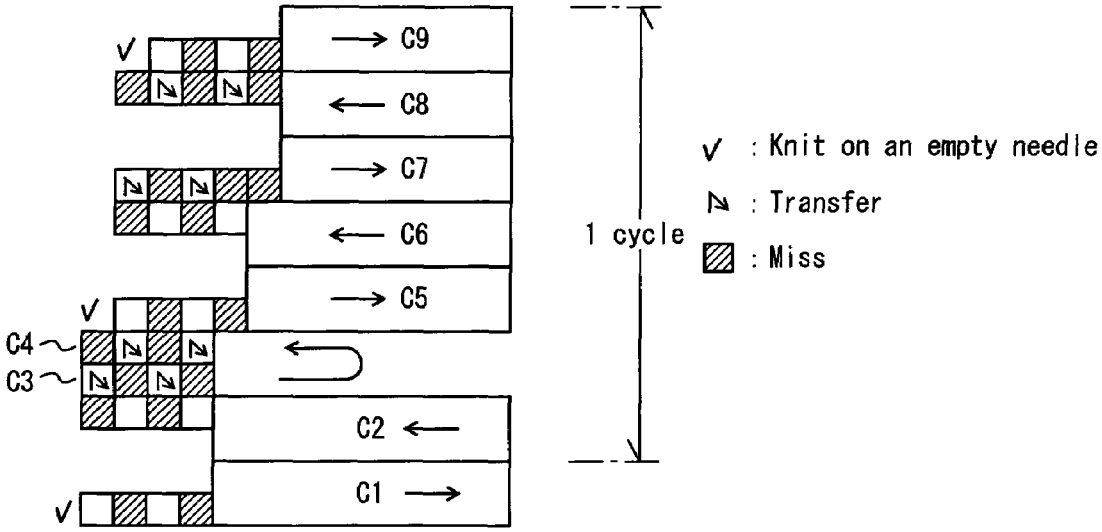
FIG. 6 is a diagram illustrating a stitch course arrangement on an end portion of a knit fabric knitted in accordance with the knitting procedure of FIG. 5.

FIG. 5 and FIG. 6 illustrate in detail knitting in the embodiment; FIGS. 1 to 4 illustrate knitted parts 10, 12, 30, 32, 48, 64 knitted in accordance with the knitting method of FIG. 5 and FIG. 6. In FIG. 5 and FIG. 6, the reference numerals C1 to C9 denote knitting course numbers, the knitting courses C2 to C9 forming one cycle of a knit fabric structure. The arrows in FIG. 6 denote the knitting direction. In the last knitting course C1 of a previous cycle, knitting on an empty needle is performed at the end portion side of the knitting width, and for instance two stitches are knitted, with an interval of one stitch between them, among four stitches in the vicinity of the end portion, while on the inside of the end portion subsequent stitches are formed as usual on the respective previous stitches. On the knitting course C2, stitches are formed on the two stitches that were not formed at the end portion of the previous course, while on the knitting course C3, as on the knitting course C1, stitches are formed on the two stitches of the end portion. On the knitting course C3, knitting is omitted on the inside of the end portion, and on the knitting course C4, knitting is likewise omitted on the inside of the end portion, so as to form two stitches that were not formed on the knitting course C3. On the knitting courses C1, C2, C5 to C9, knitting is performed as usual on the inside of the end portion.

Next, between the knitting courses C4 and C5, four stitches of the end portion are shifted to the inside by one-stitch increment, to form a double stitch. On the knitting course C5, thus, knitting is performed on the resulting empty needle of the outermost side of the knitting width, and yarn is fed for two stitches among the four stitches of the end portion; on the knitting course C6, yarn is also fed for two stitches among the four stitches of the end portion. On the knitting course C7, yarn is fed for two stitches for which no yam was fed among the four stitches of the end portion on the knitting course C6. On the knitting course C8, similarly, yarn is fed for two stitches of the end portion, and between the knitting courses C8 and C9, four stitches of the end portion are shifted to the inside by one-stitch increment, to form a double stitch; on the knitting course C9, therefore, knitting is performed on the resulting empty needle on the outermost side of the knitting width, while at the end portion are formed two stitches, with a one-stitch interval between them. Thereafter, the procedure of the knitting courses C2 to C9 is repeated as one cycle to form the neck hole or the armhole.

Figure 7:
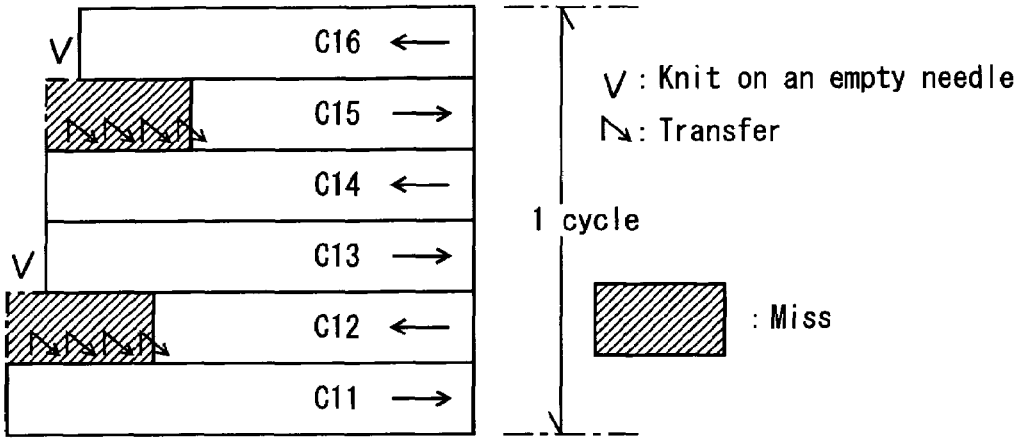
FIG. 7 is a diagram illustrating a stitch course arrangement at the end portion in a modified embodiment using miss stitches at the end portion.

In the knitting of FIG. 5 and FIG. 6, stitches are formed on alternate stitches, in other words, knitting and missing are repeated every other stitch, to lower thereby the stitch density of the end portion. Specifically, when knitting and missing are carried out every other stitch, stitches equivalent to half a knitting course of the inside are formed per one knitting course of the end portion. On the inside the number of stitches is the same, whether counted per knitting course or per stitch course. The course-direction stitch number ratio on the eight knitting courses, corresponding to the six knitting courses on the inside, is four at the end portion against six on the inside, that is, stitch density in the course direction is reduced at the end portion. In a modification of the embodiment, the entire end portion may also be missed on every predetermined course. FIG. 7 illustrates such an embodiment; in the figure, knitting courses C11 to C16 form one cycle, with missing, and hence no stitch formation, at the end portion for the knitting course C12 and the knitting course C15, so that at the end portion is formed a four-course equivalent number of stitches against a six-course equivalent number of stitches on the knitted part inside. On the knitting course C13 and the knitting course C16 knitting is performed on an empty needle on the outer side of the knitting width; since immediately prior thereto four stitches of the end portion are shifted to the inside by one-stitch increment, to form a double stitch, the slope becomes that of two stitches per six stitches (slope three).

Figure 8:
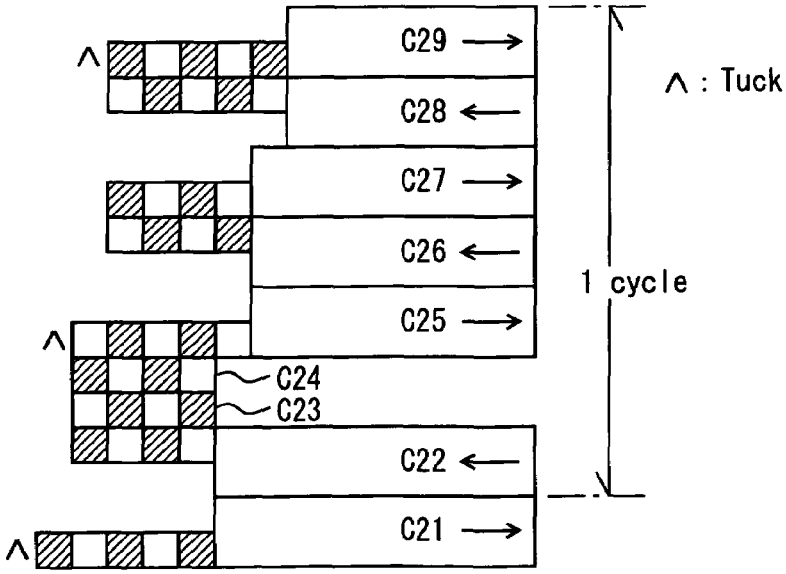
FIG. 8 is a diagram illustrating the stitch course arrangement in the modified embodiment, in which end portion shifting is omitted.

In FIG. 5 to FIG. 7, the end portion stitches are shifted (moved) to the inside to form a fashion line, although such shifting may also be omitted. FIG. 8 illustrates a modification of the knitting procedure of FIG. 5 and FIG. 6 in which shifting is omitted. In this case, knitting on an empty needle of FIG. 5 and FIG. 6 is replaced by tucking on the outermost side of the knitting width, such that no further stitch is formed on a tuck stitch, to form eventually a collar or the like. Among the knitting courses C21 to C29 of FIG. 8, the knitting courses C22 to C29 form one cycle, the outermost stitch being tucked on the knitting courses C21, C25 and C29 reducing thereby the subsequent knitting width by one stitch. In FIG. 5 to FIG. 8 is used one needle bed to knit the knitted parts corresponding to the end portion of a neck hole or an armhole, but these knitted parts may also be knitted using for instance about two needle beds.

Figure 9:
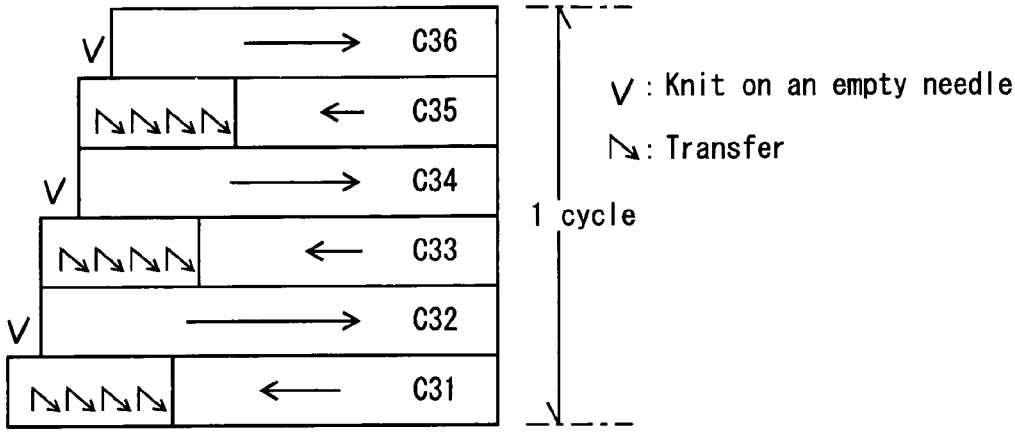
FIG. 9 is a diagram illustrating a stitch course arrangement at an end portion in a comparative embodiment.
Figure 10:
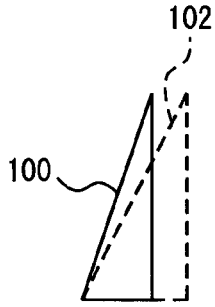
Prior Art FIG. 10
FIG. 10 is a diagram illustrating schematically the slope of a knit fabric end portion in the embodiment (solid line) and in a conventional case (broken line)

FIG. 9 illustrates a conventional procedure used for knitting a neck hole or an armhole width a slope two. On the knitting courses C31 to C36 the knitting width decreases by three stitches every six courses, with a common stitch density both at the end portion and on the inside of the knitted part. The slope of the end portion of a knitted part when knitted as in the comparative embodiment of FIG. 9 is represented in FIG. 10 as a broken line 102, whereas the slope when knitted as in the embodiment is represented as a solid line 100. In the comparative embodiment of FIG. 9 the slope is two, whereas the slope in the embodiment is three, i.e., a higher-slope neck hole or armhole can be knitted in accordance with the embodiment, whereby the width W of the sky collar (upper part of neck) in FIG. 1 can be made smaller.

The stitch density of the end portion in the embodiment is low, since the end portion has four stitch courses per six stitch courses on the inside of the knitted part. During joining of a collar or the like, moreover, holing can be prevented by shifting the stitches of the end portion to the inside and by knitting on the resulting empty needle. The relationship between knitting on an empty needle and drooping of the knit fabric is explained next. Stitches knitted on an empty needle are not linked to the stitches knitted on a previous course, and hence drooping of the knit fabric is not impaired as a consequence of linking to stitches of a previous course (adequate downward tension works to the knit fabric), and hence knitting conditions improve. By contrast, when tucking to the stitches of a previously knitted course is performed instead of knitting on an empty needle, without shifting at the end portion, the tuck stitches become linked to the stitches of the previous course and also to the stitches of the next course, which impairs drooping of the knit fabric.

For forming knitted parts on the collar or sleeves of FIG. 5 to FIG. 8 are used widened stitches or tuck stitches formed on a portion facing the neck hole or the armhole. Such widened stitches or tuck stitches, which are caught on the needle until knitting of the collar or the like, can prevent the formation of holes between the end portion of the knitted part and the collar or the like.

Stitch density of the end portion can be optimized empirically in the embodiment since the end portion is provided with four stitch courses at the end portion per six stitch courses on the inside of the knitted part. When at the end portion are formed three stitch courses per six stitch courses on the inside of the knitted part, on the other hand, the stitch count at the end portion is insufficient, which makes the stitches at the end portion readily stretchable. In the embodiment has been illustrated a slope three knitting in which the knitting width is reduced by two stitches for every six stitch courses; however, the knitting width may also be reduced by one stitch for every six stitch courses. In such a case, knitting on an empty needle may be performed on the knitting courses C1 to C9 of FIG. 5 and FIG. 6, but omitting knitting on an empty needle on the knitting course C5 or omitting shifting between the knitting courses C4 and C5.

Figure 11:
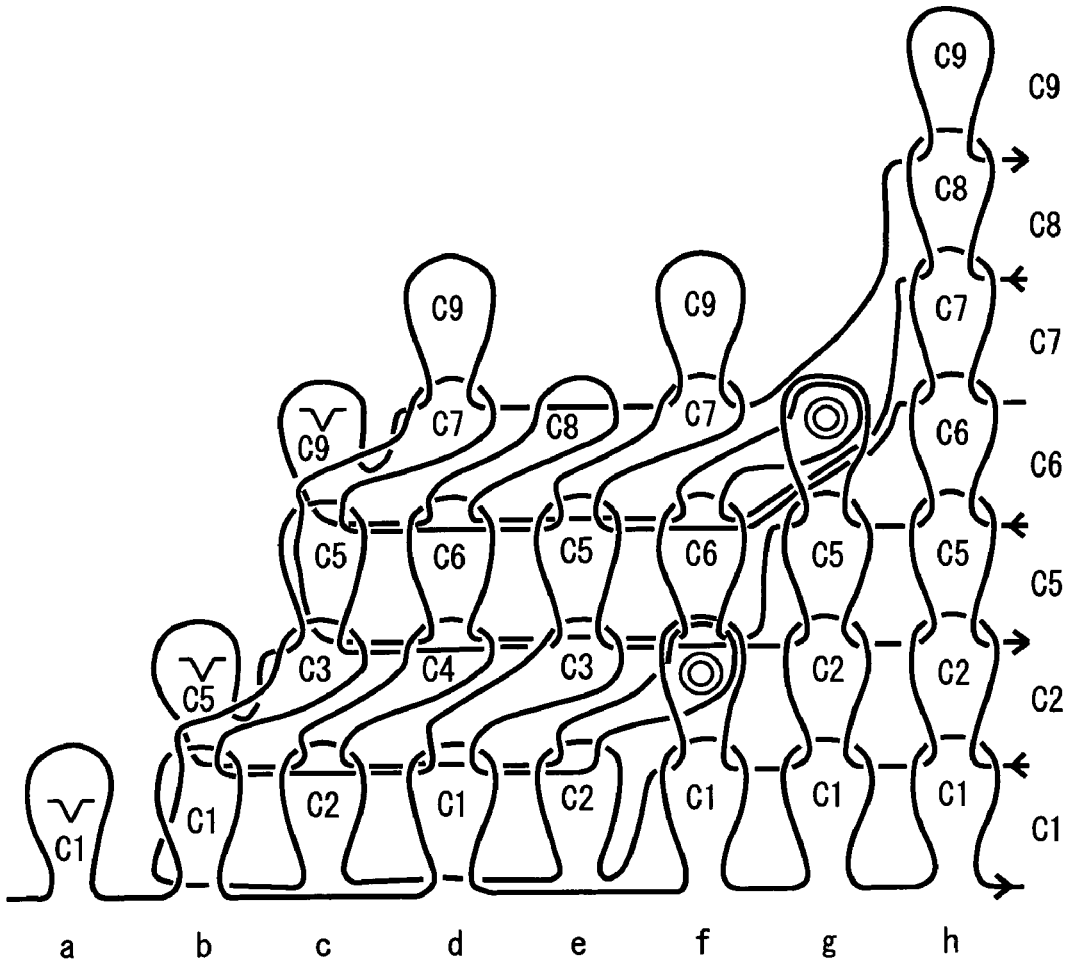
FIG. 11 is a diagram illustrating schematically a stitch arrangement in the vicinity of a neck hole of a knit fabric knitted in the embodiment.

FIG. 11 illustrates schematically a stitch structure of an end portion of knitted parts knitted in accordance with the procedure of FIG. 5 and FIG. 6. In the figure, the arrows denote the knitting direction, the symbols a through h denote the needle used, and the symbols C1 through C9 represent the knitting course on which the stitch is formed. In FIG. 11, the end portion stitches and the inside stitches, for stitches of a same knitting course, are represented with a difference in height in the course direction, although in reality the stitches of the end portion are stretched vertically and hence the height difference is smaller. When needles move away from the knitting width there remain widened stitches knitted on an empty needle; these widened stitches are used for knitting a collar or the like. As explained above, such widened stitches do not overlap with stitches on a previous knitting course, which favors drooping of the knit fabric.

Figure 12:
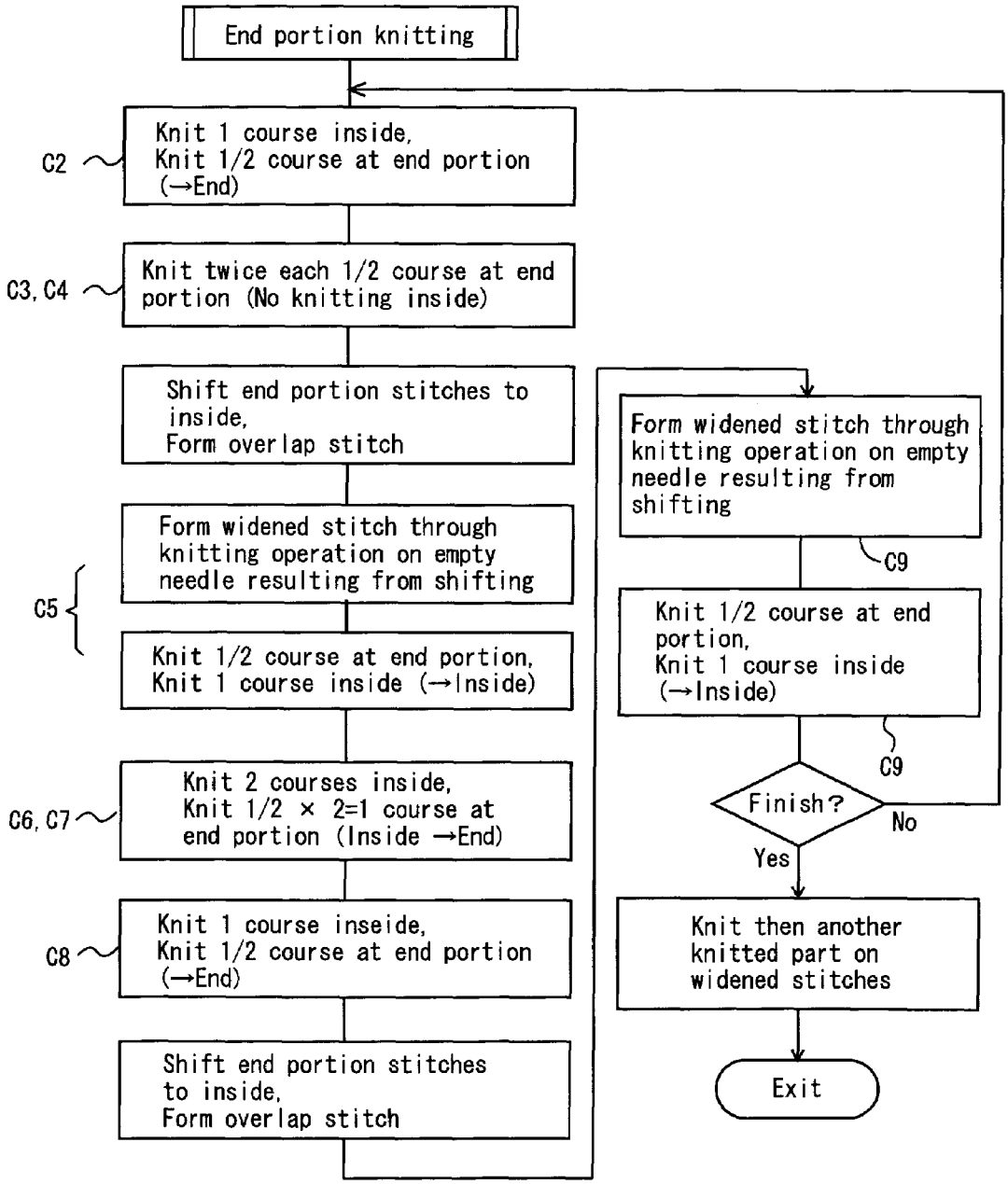
FIG. 12 is a flowchart illustrating an overview of a knitting program of the embodiment.

FIG. 12 illustrates the knitting procedure at the end portion. This knitting procedure is exemplified in FIG. 5 and FIG. 6, and thus the knitting course numbers are identical to those of FIG. 5 and FIG. 6. On the initial knitting course C2 of one cycle, one course of the inside of the knitted part is knitted, while at the end portion half a course is knitted missing every other stitch. On the knitting courses C3 and C4, the inside remains still without being knitted, while at the end portion one-stitch course is knitted by knitting twice every half course; at this time, the knitted stitches and the missed stitches are the reverse of one another on the knitting courses C3 and C4. After the knitting course C4, for instance, the carriage is suitably moved, and for instance four stitches of the end portion are shifted to the inside by one stitch increment, to form one double stitch. On the knitting course C5, a widened stitch is formed through a knitting operation on the empty needle resulting from the shift, then half a stitch course is knitted at the end portion and one stitch course is knitted on the inside. On the knitting courses C6 to C7, one stitch course is knitted per knitting course, on the inside, to a total of two stitch courses, while at the end portion half a stitch course is knitted per knitting course, to a total of one stitch course. At this time also, the knitted stitches and the missed stitches at the end portion are reversed on the knitting courses C6 and C7. On the knitting course C8, one stitch course is knitted on the inside while half a stitch course is knitted at the end portion, then four stitches of the end portion are shifted to the inside by one-stitch increment, to form one double stitch. A widened stitch is formed through a knitting operation on the empty needle resulting from the shift, then half a stitch course is knitted at the end portion and one stitch course is knitted on the inside. The cycle comprising the knitting courses C2 to C9 is then repeated a required number of times.

Meanwhile, the widened stitches knitted on empty needles are left caught on the needles, the needles being then removed from the knitting width and being placed in a pause state. Once knitting of the knitted part is over, the other knitted parts such as a collar, sleeve rubber or the like are knitted using the needles on which are caught the widened stitches knitted on an empty needle.

Figure 13:
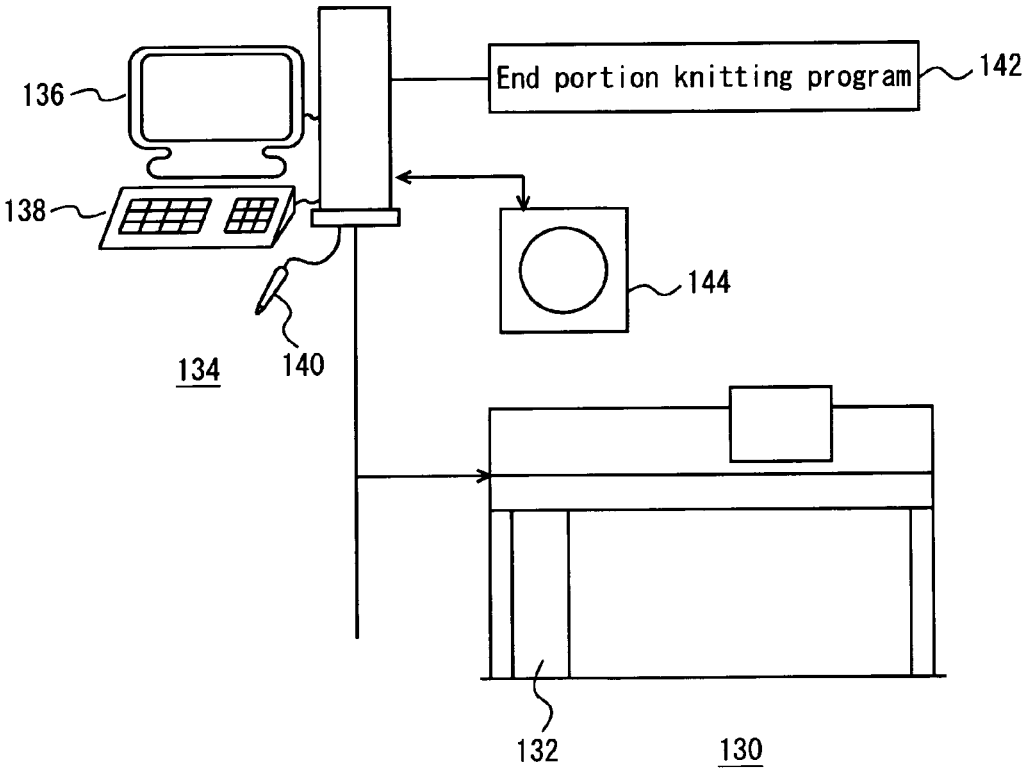
FIG. 13 is a block diagram of a knitting system of the embodiment.

FIG. 13 illustrates a knitting system of the embodiment; in the figure, the reference numeral 130 denotes a two-bed or a four-bed knitting machine, and 132 denotes a control unit. The reference numeral 134 denotes a knit design device comprising a display unit 136 and input means such as a keyboard 138, a stylus 140 or the like; in the knit design device 134 is stored an end portion knitting program 142 of the embodiment, and is generated knitting data of a knit garment using the end portion knitting of the embodiment. The end portion knitting program 142 can be input to the knitting design device 134 by way of a storage medium 144 or the like; in addition, the generated knitting program can also be input to a horizontal knitting machine 130 via the storage medium 144, a LAN or the like.

The invention claimed is:

1. A knitting method of a knit fabric, comprising the steps of:

making stitch density on an end portion of a knitted part lower than on the inside of the knitted part by regularly performing a missing operation with a higher frequency at the end portion than on the inside of the knitted part;

performing a formation operation of a widened stitch on an empty needle on said end portion, or performing a tuck operation on a needle that holds a stitch, at a rate of once every three to six stitch courses on the inside of said knitted part;

reducing the number of stitches formed on a next and subsequent knitting courses by the number of widened stitches formed on said empty needle or by the number of tuck stitches, while leaving said widened stitches or tuck stitches caught on the needle; and knitting subsequently another knitted part on said widened stitches or tuck stitches.

2. The knitting method of a knit fabric according to claim 1, wherein on a first knitting course of said end portion a knitting operation is performed for predetermined stitches of the end portion and a missing operation is performed for other stitches of the end portion;

and wherein on said end portion is formed a total of one stitch course of said first knitting course and a second knitting course by, on the second knitting course, knitting said end portion transposing the stitches of the knitting operation and the stitches of the missing operation of the first knitting course.

3. The knitting method of a knit fabric according to claim 1, wherein a stitch of said end portion is moved to the inside of the knitted part to form an overlap stitch of a destination of an inside stitch and the end portion stitch, the formation operation of said widened stitch being performed next on an empty needle at said end portion resulting from the movement of the stitch.

4. The knitting method of a knit fabric according to claim 2, further comprising a step of forming one stitch course on said end portion by carrying out said first knitting course and second knitting course for said end portion, without forming a stitch course for the inside of said knitted part.

5. The knitting method of a knit fabric according to claim 1, wherein four stitch courses are knitted at said end portion for every six courses knitted on the inside of said knitted part, while in the meantime is performed a two-stitch formation operation of widened stitches on said empty needle, or a two-stitch tuck operation on a needle that holds the stitches, the number of formed stitches being decreased by two stitches.

6. A knit fabric having a lower stitch density at an end portion of a knitted part of the knit fabric than on the inside of the knitted part, and having a predetermined slope at the end portion of the knitted part through the presence of widened stitches or tuck stitches at said end portion at a rate of one stitch per every three to six stitch courses, and through a reduction in the number of stitches on a subsequent stitch course by the number of said widened stitches or tuck stitches, wherein another knitted part is knitted subsequently on said widened stitches or tuck stitches.

7. The knit fabric according to claim 6, wherein said end portion exists around a neck hole or an armhole of the knit fabric, the slope of the neck hole or of the armhole changing through sequential change in the slope of the end portion.

8. The knit fabric according to claim 6, having four stitch courses, and two widened stitches or tuck stitches at said end portion, for six stitch courses on the inside of said knitted part.

9. A computer-readable medium storing computer-executable instructions for knitting by performing operations comprising:

making stitch density on an end portion of a knitted part lower than on the inside of the knitted part by regularly performing a missing operation with a higher frequency at the end portion than on the inside of the knitted part;

performing a formation operation of a widened stitch on an empty needle on said end portion or performing a tuck operation on a needle that holds a stitch, at a rate of once every three to six stitch courses on the inside of said knitted part;

reducing the number of stitches formed on a next and subsequent knitting courses by the number of widened stitches formed on said empty needle or by the number of tuck stitches, while leaving said widened stitches or tuck stitches caught on the needle; and knitting subsequently another knitted part on said widened stitches or tuck stitches.

* * * * *